US008355517B1

(12) United States Patent
Fretz

(10) Patent No.: US 8,355,517 B1
(45) Date of Patent: Jan. 15, 2013

(54) HEARING AID CIRCUIT WITH FEEDBACK TRANSITION ADJUSTMENT

(75) Inventor: Robert J. Fretz, Maplewood, MN (US)

(73) Assignee: IntriCon Corporation, Arden Hills, MN (US)

( * ) Notice: Subject to any disclaimer, the term of this patent is extended or adjusted under 35 U.S.C. 154(b) by 260 days.

(21) Appl. No.: 12/895,831

(22) Filed: Sep. 30, 2010

Related U.S. Application Data

(60) Provisional application No. 61/247,339, filed on Sep. 30, 2009.

(51) Int. Cl.
*H04R 25/00* (2006.01)

(52) U.S. Cl. ..... 381/318; 381/317

(58) Field of Classification Search ..... 381/317, 381/318, 320, 321
See application file for complete search history.

(56) References Cited

U.S. PATENT DOCUMENTS

| | | | |
|---|---|---|---|
| 3,538,259 | A | 11/1970 | Brahman |
| 5,091,952 | A | 2/1992 | Williamson et al. |
| 5,276,739 | A | 1/1994 | Krokstad et al. |
| 5,278,912 | A | 1/1994 | Waldhauer |
| 5,488,668 | A | 1/1996 | Waldhauer |
| 5,937,070 | A | 8/1999 | Todter et al. |
| 6,072,884 | A | 6/2000 | Kates |
| 6,173,063 | B1 | 1/2001 | Melanson |
| 6,219,427 | B1 | 4/2001 | Kates et al. |
| 6,434,246 | B1 | 8/2002 | Kates et al. |
| 6,434,247 | B1 | 8/2002 | Kates et al. |
| 6,498,858 | B2 | 12/2002 | Kates |
| 7,519,193 | B2 | 4/2009 | Fretz |
| 2003/0026442 | A1 | 2/2003 | Fang et al. |
| 2003/0053647 | A1 * | 3/2003 | Kates ..... 381/318 |
| 2003/0138110 | A1 | 7/2003 | Sato |
| 2005/0036632 | A1 | 2/2005 | Natarajan et al. |
| 2009/0067651 | A1 | 3/2009 | Klinkby et al. |
| 2010/0040239 | A1 | 2/2010 | Fretz |

FOREIGN PATENT DOCUMENTS

JP 63-001296 * 6/1988

OTHER PUBLICATIONS

Hosoi, Shigeru, Howling Suppressing Device, Jun. 1, 1988, Translation of Japanese Patent Publication 63-001296.*

* cited by examiner

*Primary Examiner* — Brian Ensey
(74) *Attorney, Agent, or Firm* — Shewchuk IP Services, LLC; Jeffrey D. Shewchuk

(57) ABSTRACT

A feedback transition threshold algorithm assesses and responds to feedback transition events in a hearing aid. The feedback transition threshold algorithm considers short duration trouble indicators, with the preferred primary short duration trouble indicators being the correlation witnessed between the incoming signal in a given frequency band and the same signal delayed by the estimated feedback loop time. If the short duration trouble indicators indicate that feedback squeal is likely and that the external feedback path is changing too quickly for accurate correction by the internal adaptive feedback reduction filter, when the signal level crosses the feedback transition threshold gain is reduced in that frequency band.

48 Claims, 5 Drawing Sheets

(PRIOR ART) FIG. 1

HEARING AID CIRCUIT WITH FEEDBACK TRANSITION ADJUSTMENT

CROSS-REFERENCE TO RELATED APPLICATION(S)

The present application claims priority from U.S. Provisional Application No. 61/247,339, filed Sep. 30, 2009, entitled Hearing Aid Circuit With Feedback Transition Adjustment.

BACKGROUND OF THE INVENTION

The present invention relates to hearing aids, and more particularly to hearing aid signal processing circuits having a feedback reduction algorithm.

The primary components of any body worn hearing aid include a microphone which converts an acoustic sound into an electrical signal, an amplifier which increases and often modifies the electrical signal, and a speaker (commonly called a receiver) which converts the amplifier output into a generated acoustic sound. Because the sound output from the receiver propagates three-dimensionally, a basic difficulty of hearing aids occurs when the generated acoustic sound from the receiver travels back as a sound wave received by the microphone. If the amount of amplification gain is sufficient and the internal and external delays result in a multiple of 360° at a given frequency, the feedback loop will become unstable, wherein the each loop of signal (electrically forward through the amplifier, and then with a portion fed acoustically back through physical space) increases. Acoustic feedback is well known as a loud and annoying whistle or buzz heard in public address systems, and is also well known as loud and annoying whistles, squeals chirps or buzzes generated in hearing aids.

To attempt to minimize acoustic feedback, one strategy is to fit the hearing aid as tightly as possible into the ear canal between the microphone and the receiver, and therefore physically minimize the amount of transmission of the acoustic signal from the receiver back to the microphone. However, tight fits are difficult to achieve and uncomfortable. Further, tight fits in the ear canal result in an "occlusion" effect, and many hearing aid wearers will complain that the occlusion effect prevents them from properly hearing their own voice in a natural way with the hearing aid.

With the difficulties in stopping the physical transmission of acoustic feedback, processing strategies of the electrical signal within the hearing aid are also used to reduce feedback. Accordingly, feedback cancellers are an important part of modern hearing aid design. By canceling the annoying squeal of feedback, hearing aids are more desirable to wear. Feedback cancellation processing algorithms allow more gain and a less tight fit that is a more comfortable fit in the ear canal.

An older feedback cancellation technique uses a notch filter in the forward path to reduce the gain at the offending frequency. Feedback typically occurs in the 1 to 7 kHz range. Unfortunately, this is also a frequency range carrying much sound information that most users desire to hear. This notch filter technique is now seldom used in hearing aids since it results in a reduction of gain in a frequency range where gain is desired to best improve the hearing results of the wearer.

More modern feedback cancellation is made possible with digital amplifiers and processors, and involves phase cancellation. The basic premise of phase cancellation is to attempt to determine which portion of the electrical signal being processed by the amplifier occurs from the external acoustic/physical feedback loop, and then to add a processor-generated portion, opposite in phase, and timed to the electrical signal so the added portion exactly and oppositely removes or cancels the transmitted acoustic feedback known to occur.

If it was possible in real time and at low cost to accurately identify which portion of the microphone signal resulted from feedback, it would be relatively easy to have the algorithm remove acoustic feedback. A first problem is that neither the incoming (non-feedback) acoustic signal nor the exact magnitude of the feedback acoustic signal is known a priori. Different acoustic conditions, such as changes in the physical fit of the hearing aid in the ear canal, sound reflective surfaces near the ear, changes in the physical shape of the ear canal during jaw movement, etc., will change the magnitude and frequency profile of the feedback acoustic signal. A second problem is that the exact time for the acoustic feedback signal to travel from the receiver to the microphone is not known. The amount of time required for the acoustic signal to directly travel the distance from the receiver to the microphone is reasonably short (on the order of 20-100 microseconds), and can be closely determined for the geometry of any particular hearing aid. A greater delay is typically introduced in the electrical processing time of the signal (typically 2-10 milliseconds), which can be precisely determined for the processor in any particular hearing aid. While sampling rates of 40 kHz or more are needed to fully reproduce the spectrum of human hearing, sampling rates for hearing aids are more commonly around 16 or 20 kHz, providing a bandwidth of 8 or 10 kHz. At a sampling rate of 16 kHz, a 6 millisecond processing time and a typical in-the-canal hearing aid geometry, the acoustic feedback from the output will be picked up about 100 samples later. However, feedback is significantly affected by sound reflection (off a telephone hand set, etc.), and the time delay for the echo wave depends upon the instantaneous location of the sound reflective surface, which is not known a priori and can change quickly. That is, the magnitude and frequency profile (a/k/a the feedback transfer function) and the time delay of sound transmitted in the acoustic feedback channel are not constant, but rather will change during events and conditions of the hearing aid.

Phase cancellation is achieved in practice with an internal filter (typically finite impulse response, or "FIR" filter) that is adaptively adjusted such as with a least mean squared controller to mimic the external acoustic feedback path. Subtracting the output of the internal filter from the input signal from the microphone results in significant cancellation of the acoustic feedback while maintaining the desired forward gain. For this design to work well, the internal FIR filter must match the external path in both amplitude and phase (exact feedback loop delay timing) for all frequencies that are potential problems.

For the vast majority of circumstances, modern phase cancellation algorithms can increase the stable gain of a hearing aid up to 15 or 20 dB beyond the stable gain without feedback cancellation. However, circumstances in which the input is "self-correlated" pose special problems. In a self-correlated signal, such as music, ringtones or other periodic sound inputs, the incoming acoustic signal in a particular frequency band may be identical both before and after the feedback loop delay, such that the incoming acoustic signal is completely indistinguishable from the acoustic feedback signal in the microphone output. In addition to having an adaptive FIR internal feedback filter, modern phase cancellation algorithms can include subroutines to modify the method of adjusting the FIR coefficients for occasions when the input is self-correlating. For example, U.S. Pat. No. 7,519,193 owned by the assignee of the present invention and incorporated herein by reference, discloses a phase cancellation algorithm wherein a correlation detector and a phase shifter are used in the feed forward path to attempt to determine which portion of the incoming signal is due to external acoustic feedback and to attempt to prevent phase matching between the external acoustic feedback signal and the incoming signal even when the incoming signal is self-correlating.

While feedback cancellation algorithms can greatly increase permissible gain, they still have trouble adaptively correcting during times when the external feedback path is rapidly changing, such as raising one's hand or a telephone receiver to the ear, combing one's hair over the ear, during jaw motion or other events. Even with advanced adaptive feedback cancellation algorithms, some feedback squeal can be heard when the external feedback path rapidly changes. This feedback squeal can result either from classical feedback, or as "entrainment" when the correction generated by the feedback cancellation algorithm (instead of acoustic feedback of the original signal) actually creates an audible artifact in the output. Attempts to identify and correct the entrainment problem are disclosed in U.S. Patent Pub. Nos. 2003/0026442 and 2005/0036632, incorporated by reference.

SUMMARY OF THE INVENTION

The present invention is a feedback transition threshold algorithm which assesses and responds to feedback transition events, and a hearing aid using the algorithm. The feedback transition threshold algorithm considers short duration trouble indicators, with the preferred primary short duration trouble indicators being the correlation witnessed between the incoming signal in a given frequency band and the same signal delayed by the estimated feedback loop time. If the short duration trouble indicators indicate that feedback squeal is likely and that the external feedback path is changing too quickly for accurate correction by the internal adaptive feedback reduction filter, then the feedback transition threshold algorithm quickly reduces the gain of the digital amplifier in that frequency band. Once the feedback transition event concludes and stability is achieved, the gain reduction is quickly smoothed back to a full goal gain value. Because the reduction rarely occurs and then usually lasts for less than a few seconds and is frequency band specific, the effect of the reduction of the maximum output threshold on the sound quality is minimal.

While the above-identified drawing figures set forth a preferred embodiment, other embodiments of the present invention are also contemplated, some of which are noted in the discussion. In all cases, this disclosure presents the illustrated embodiments of the present invention by way of representation and not limitation. Numerous other minor modifications and embodiments can be devised by those skilled in the art which fall within the scope and spirit of the principles of this invention.

DETAILED DESCRIPTION

Figure 1:
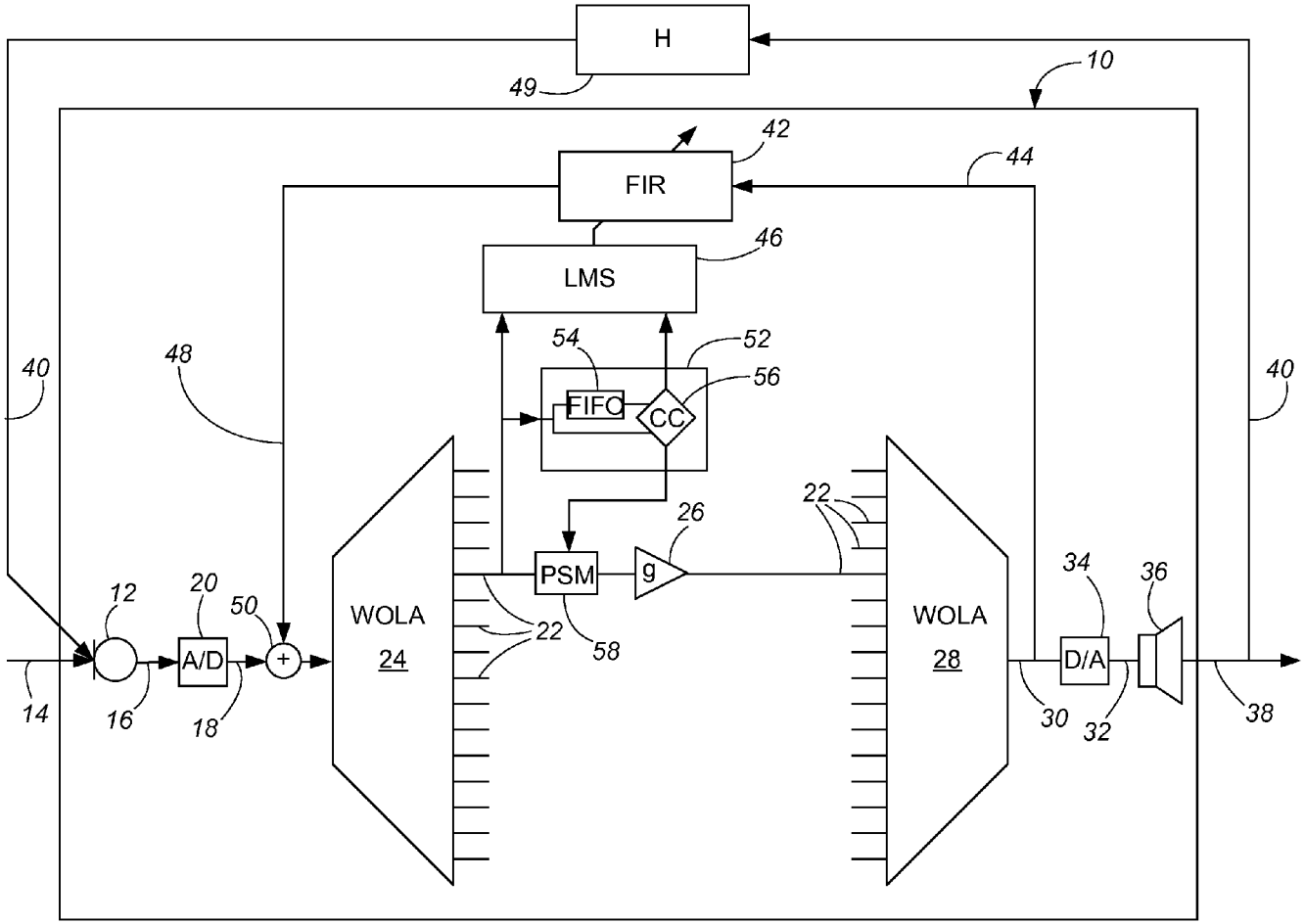
FIG. 1 is a schematic drawing of the hearing aid of U.S. Pat. No. 7,519,193.

FIG. 1 shows a prior art system such as that disclosed in U.S. Pat. No. 7,519,193. A hearing aid 10 includes a microphone 12 which senses sounds 14 and converts the sounds 14 into an electrical signal 16. The electrical signal 16 is converted to a digital signal 18 using an analog-to-digital ("A/D") converter 20, and then separated out into frequency bands 22 such as with band pass filters or a weighted overlap-add analyzer 24, in the preferred system into sixteen frequency bands 22 covering the 20 to 8,000 Hz range. Each frequency band 22 is fed through a gain amplifier 26 (only one of the frequency bands 22 shown in detail) before being recombined in a summer or more preferably a weighted overlap-add synthesizer 28. The desired gain in each frequency band 22 (i.e., for each gain amplifier) is programmable to match the hearing deficiency profile of a particular wearer as determined during hearing aid fitting. The combined output 30 is converted into an analog signal 32 with a digital-to-analog ("D/A") converter 34, which analog signal 32 is fed to a receiver 36 to be output as an audible output 38. The audible output 38 is heard by the hearing impaired individual, but also a portion of the output 38 travels through an external acoustic feedback path 40 to be picked up by the microphone 12.

In order to reduce the amount of feedback, the combined output 30 is also fed through a FIR filter 42 in an internal electric feedback control path 44. The coefficients of the FIR filter 42 are controlled by an adaptive controller 46, such as a least mean squared ("LMS") controller, which senses the signal in each frequency band 22 in an attempt to have the feedback FIR filter 42 exactly match the external feedback transfer function and delay 49 at any acoustic conditions. The output 48 of the feedback FIR filter 42 is then subtracted out from the incoming sound signal 14 in a summer 50.

A correlation detector 52 is applied to the feed forward signal in each frequency band 22. As noted in U.S. Pat. No. 7,519,193, the preferred correlation calculation is performed in each frequency band 22 on data frames separated in time by the total estimated feedback loop delay (in the preferred embodiment, about a 5 ms delay through the forward processor and about a 1 ms delay through the external feedback path 40). For instance, the preferred correlation detector 52 compares a 16 ms frame of signal against a 16 ms frame of the stored signal which has been delayed by 5.5-8 ms in a FIFO shift register 54, with the 5.5-8 ms delay being adjustable by a phase shifter or correlation analyzer 56 to attempt to determine the highest correlation within that frequency band 22. The preferred comparison is performed every 16 ms. When the calculated correlation coefficient is very high, the small phase shift measurement algorithm adjusts phase shift in a phase shifter 58 in the feed forward path to obtain a feedback path value $\beta$, with the phase shift performed iteratively over several loops to prevent audible artifacts in the feedback processor. The correlation coefficients may also be used in the adaptive controller 46 for the FIR filter 42.

Figure 2:
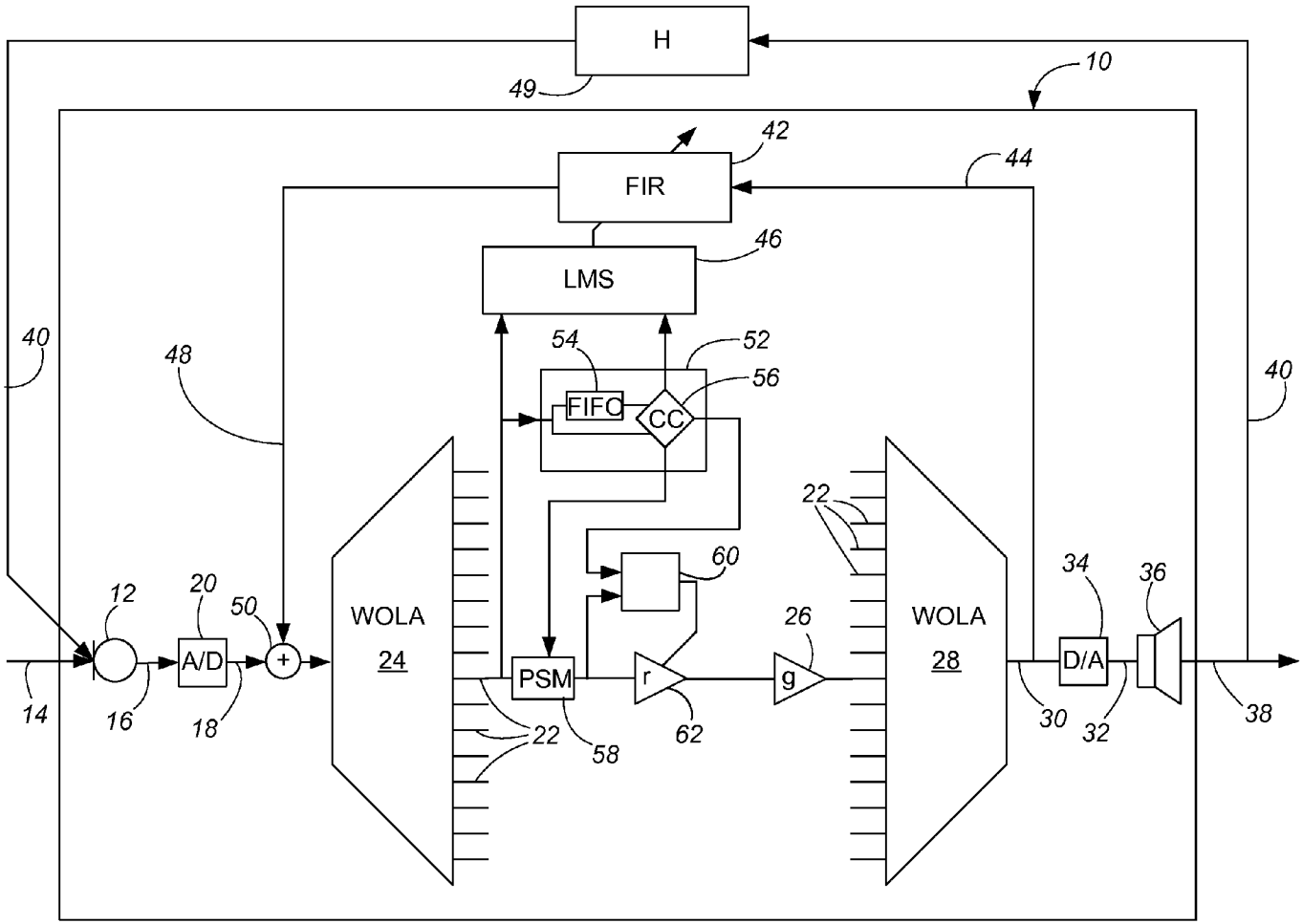
FIG. 2 is a schematic concept drawing of the hearing aid of FIG. 1 modified to include the feedback transition adjustment of the present invention.

It should be noted that everything between the A/D and D/A converters 20, 34 is generally performed mathematically in a digital signal processing ("DSP") chip (not separately shown), and that these various elements in FIGS. 1 and 2 merely indicate logical blocks in the flowchart of the firmware for the DSP chip rather than discrete electrical components. The A/D and D/A converters 20, 34 themselves can be provided separately, as part of the DSP chip, or as parts of the microphone 12 and receiver 36.

While the processing detailed in U.S. Pat. No. 7,519,193 works quite well, it still fails to adequately control feedback artifacts from being generated in certain situations when the feedback path 40 rapidly changes. The present invention shores up this shortcoming in a very different way. The idea of this invention is to adjust and reduce the gain in a given frequency band 22 in certain circumstances when the external feedback path 40 is transitioning rapidly in a short duration. A key observation for this invention is that when the external acoustic feedback path 40 is changing rapidly, there can be indicators of acoustic feedback (denoted "short duration trouble indicators") while there is insufficient information to do a sufficiently rapid accurate matching of the internal FIR filter 42. For use herein, the term "short duration" means an identified change in the external feedback path 40 which occurs on the order of seconds, preferably as fast as or faster than 50 milliseconds to 2 seconds.

In its preferred form, the present invention uses the correlation coefficient (denoted "$CC_{Hz}$") in each band 22 as a primary short duration trouble indicator to give an initial indication of when the feedback path 40 may be changing too quickly for either standard feedback adaptive FIR correction or with the small phase change measurement algorithm. Several further quick (i.e., performed within a single feed forward frame processing time) tests of other short duration trouble indicators are verified to determine potential cause for the high correlation other than feedback. If no justification for the high correlation is identified, then a feedback transition event is identified and the output in that frequency channel 22 is immediately limited. As soon as stability in the short duration trouble indicator(s) is witnessed indicating the feedback transition event is over, output limiting within that frequency channel 22 is then quickly and smoothly removed. Because most significant external feedback path changes which are difficult to correct occur within a time window of about a tenth of a second to several seconds (e.g., the amount of time to raise a telephone handset and position it in a stationary position next to one's ear, to lean against a wall, etc.), the correlation-induced frequency band gain reduction of the present invention will be fully removed within a second or two after the feedback transition event has completed. Some short duration trouble indicators can be part of the feedforward signal as a whole, but more commonly the short duration trouble indicators are assessed within a particular frequency band 22 where the trouble is likely to be occurring.

The preferred embodiment of the present invention, modifying the circuit of U.S. Pat. No. 7,519,193, is shown in FIG. 2. The correlation coefficients are used not only in the small phase change measurement algorithm 58 and in the adaptive controller 46 for the FIR feedback filter 42, but also in a feedback transition threshold adjustor 60. The preferred feedback transition threshold adjustor 60 also receives and reviews the signal in its frequency band 22. The preferred control mechanism for the feedback transition threshold adjustor 60 is, only for a limited time caused by an identified feedback transition event, to adjust a feedback transition threshold (denoted "FbTTh"), which in turn is applied to a negative gain (gain reduction) in a gain amplifier 62.

Figure 3:
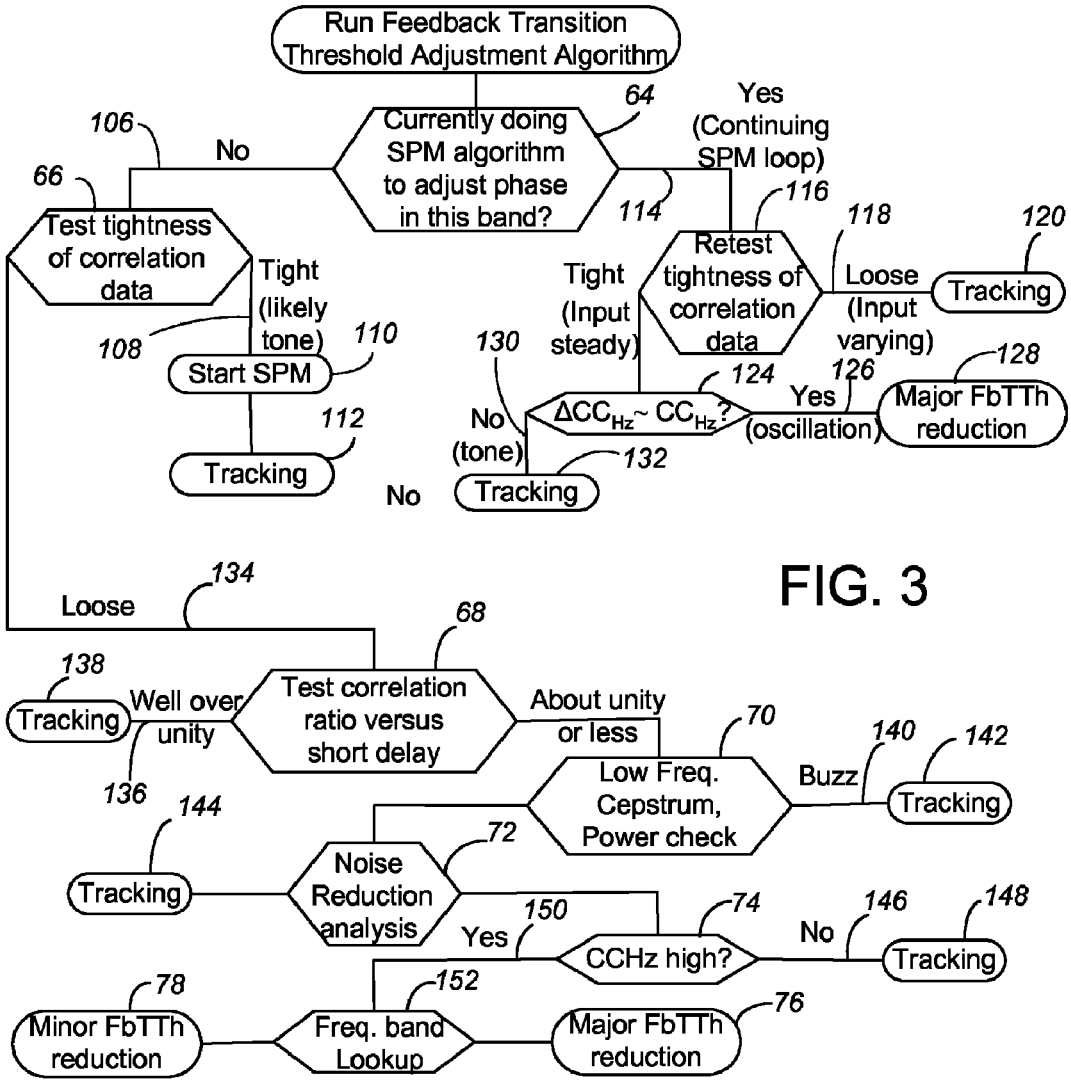
FIG. 3 is a flow chart of the preferred feedback transition adjustment algorithm of the present invention.

The logical flow chart for the preferred feedback transition threshold adjustor 60 is shown in FIG. 3. The primary short duration trouble indicator is the correlation coefficient $CC_{Hz}$ in that particular subband 22 as determined by the correlation detector 52, but the preferred algorithm involves a number of preliminary steps 64, 66, 68, 70, 72 attempting to rule out other possibilities or correct the potential feedback problem before performing the main analysis 74 of the short duration trouble indicator. If the analysis 74 determines that correlation coefficient $CC_{Hz}$ is high and the preliminary steps 64, 66, 68, 70, 72 could not rule out other possibilities or correct the potential feedback problem, the result is a major reduction 76 or a minor reduction 78 in the feedback transition threshold FbTTh. (The specifics of the major reduction 76 and the minor reduction 78 will be explained relative to FIGS. 5 and 6, and the specific effect of the reduced feedback transition threshold on the gain reduction from the gain amplifier 62 will be subsequently explained relative to the signal shown in FIGS. 7 and 8). However, the vast majority of the algorithm will result in what has been called a "tracking" algorithm.

Figure 4:
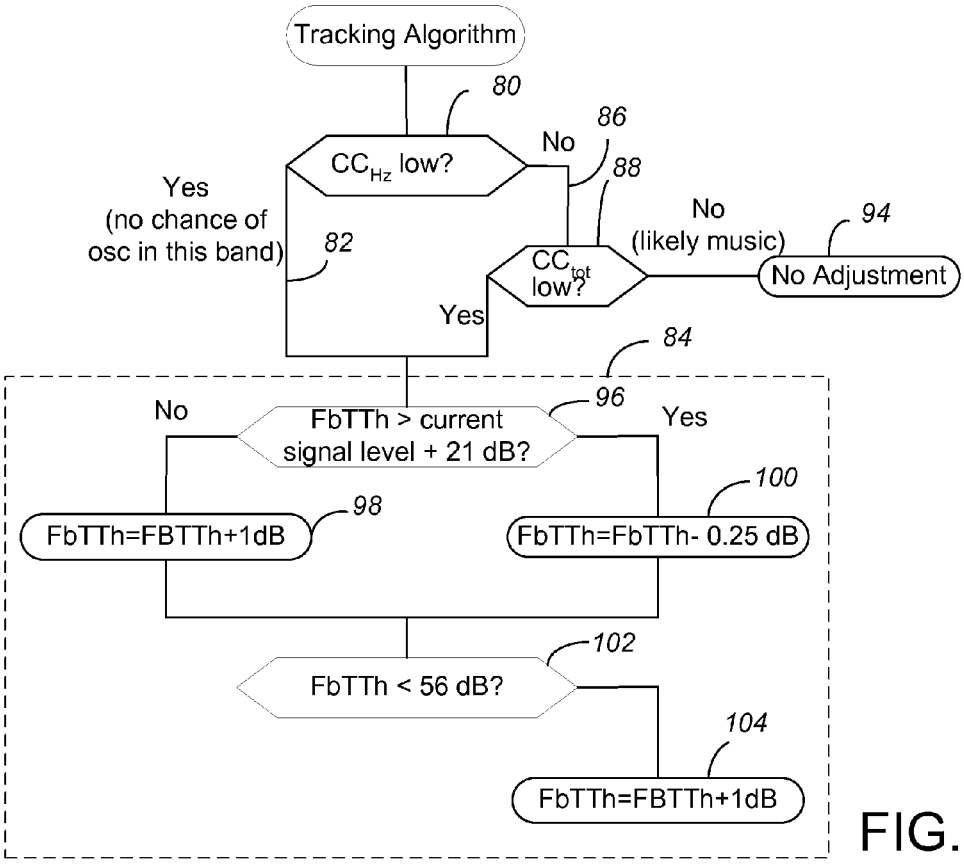
FIG. 4 is a flow chart of the preferred feedback transition threshold tracking algorithm of the present invention.

Before fully explaining all the preliminary steps 64, 66, 68, 70, 72, we will start with a description of the "tracking" algorithm, which is essentially normal operation of the hearing aid 10. The preferred tracking algorithm is shown in FIG. 4, and works in conjunction with the small phase change measurement (denoted "SPM") algorithm described in U.S. Pat. No. 7,519,193. The first step 80 is to look at the level of correlation $CC_{Hz}$ between the input and its 6 ms delayed shift register counterpart as determined at the correlation analyzer 56 for this particular subband 22. If there is a low level 82 of correlation there is little or no chance of feedback oscillation occurring in this subband 22. "Low" correlation coefficients will occur during the vast majority of hearing aid conditions, such as during 90 percent or more of common conditions for the average hearing aid user. In the preferred embodiment, a "low" correlation coefficient $CC_{Hz}$ in this particular subband 22 is a value less than 0.5. As long as the correlation detector 52 indicates low levels of correlation, the feedback transition threshold tries to track 84 at 21 dB higher than the current signal level or a minimum of 56 dB SPL.

Even if the correlation coefficient $CC_{Hz}$ in this particular subband 22 is not low 86, the next step 88 to look at the correlation coefficients from other subbands 22, expressed as a total correlation coefficient $CC_{tot}$. If the correlation coefficient $CC_{tot}$ in all the subbands are low 90, then the feedback transition threshold performs the tracking function 84. If neither the correlation coefficient $CC_{Hz}$ in this particular subband 22 nor the correlation coefficient $CC_{tot}$ in all the subbands are low, then there is a good chance the input is music 92, in which case no adjustment 94 (neither tracking nor reduction) is performed on the feedback transition threshold.

The specific tracking function 84 involves small increases or decreases to the feedback transition threshold. If the feedback transition threshold determined at block 96 to be less than 21 dB over the current signal level, then it is increased 98 by 1 dB. If the feedback transition threshold is more than 21 dB over the current signal level, then it is decreased 100 by 0.25 dB. Regardless of how the feedback transition threshold compares to the current signal level at block 96, if the feedback transition threshold is less than 56 dB at block 102, then there is an additional step 104 of increasing the feedback transition threshold by 1 dB. Thus, as a whole the tracking function 84 results in one of four changes to the feedback transition threshold every 16 ms to track at either 21 dB higher than the current signal level to a minimum of 56 dB, either increasing 2 dB, increasing 1 dB, increasing 0.75 dB, or reducing 0.25 dB. In this way the feedback transition threshold will have a fairly smooth tracking of the current signal level in this subband 22, with a bias to smoothly increase more quickly than smoothly decrease. If the feedback transition threshold had any remaining decreases from earlier analysis of the signal, then the feedback transition threshold is smoothly ramped back up to its full goal value of 21 dB higher than the current signal level.

Note that tracking occurs as the vast majority of outcomes in the preferred algorithm shown in FIG. 3. Rather than as a final outcome, the tracking algorithm can be easily performed earlier in the order of considerations, such as performing tracking as a first step upon starting the feedback transition threshold adjustment algorithm.

With this description of how the smooth tracking will occur in most outcomes of the feedback transition threshold adjustment algorithm, we return to the analysis of FIG. 3 to describe the events that will result in a major reduction or a minor reduction of the feedback transition threshold. A first step 64 depends upon whether the SPM algorithm is running to adjust phase in this band. For most operation of the hearing aid, the SPM algorithm is not running 106, resulting in an analysis 66 of the tightness of the correlation data. The preferred test 66 for analyzing the tightness of the correlation data considers the standard deviation over the mean of the correlation coefficient data points. A tight value 108 (low ratio of standard deviation to mean, such as a value under 0.35) indicates a likelihood that the correlation tightness is due to a tone in the input signal. The SPM algorithm is started 110 in this band. Further, the feedback transition threshold FbTTh is allowed to perform the tracking adjustment 112 to track the signal level in that band to a preferred value (21 dB over current level, minimum 56 dB SPL, described with reference to FIG. 4.)

Next we'll look at the iteration when the SPM algorithm has been started 110 and accordingly is determined at step 60 to be running 114. At this point, the SPM algorithm was started at least one iteration (16 ms or more in the data) ago. The algorithm retests 116 the tightness of the correlation coefficient data. If the data here is loose 118, that indicates that the input is varying, and we merely continue with the tracking 120. Conversely, if the retest 116 continues to show tight data 122, then we look 124 to see with the change in the correlation coefficient $\Delta CC_{Hz}$ caused by the start up of the SPM algorithm roughly matches the correlation coefficient $CC_{Hz}$. If it does 126, then we can assume feedback oscillation is occurring. To prevent the feedback oscillation from becoming too loud, we perform a major reduction 128 in the feedback transition threshold. If the change in the correlation coefficient $\Delta CC_{Hz}$ caused by the start up of the SPM algorithm doesn't roughly match the correlation coefficient $CC_{Hz}$, then there is a high likelihood 130 that the correlation is caused by music or other self-correlating periodic input, which will be sufficiently handled by the FIR feedback filter 42. The feedback transition adjustment algorithm merely has the feedback transition threshold track 132 the current signal level as shown in FIG. 4.

Next we'll look at the case when the SPM algorithm is not running 106 and the correlation coefficient data is loose 134. The feedback transition adjustment algorithm continues with other sets of inquiries 68, 70, 120, 122, seeking to identify a potential feedback transition event by ruling out other causes. A test 68 is performed to check the feedback loop delay correlation coefficients against a shorter delay, such as checking 6 ms delay correlation coefficients relative to 3.5 ms delay correlation coefficients. Significantly higher 3.5 ms delay correlation coefficients than 6 ms delay correlation coefficients could not possibly be caused by feedback oscillation when the feedback loop time is 5-7 ms. If the ratio of 3.5 ms delay correlation coefficients to 6 ms delay correlation coefficients is well over unity 136 (such as a ratio of 1.12 or more), then the feedback transition threshold only tracks 138 the current signal level as shown in FIG. 4.

If the short delay correlation coefficients 68 can't be used to rule out feedback oscillation, then the preferred algorithm next performs a low frequency cepstrum analysis and power check 70, trying to determine whether the high correlation coefficients in this band 22 are caused by a buzz sound 140. If a buzz sound 140 in the input is identified by the low frequency cepstrum analysis and power check 70, then the feedback transition threshold only tracks 142 the current signal level as shown in FIG. 4.

Finally the preferred algorithm checks the noise reduction analysis 72. Active noise reduction suggests no feedback oscillation, so the feedback transition threshold tracks 144 the signal level.

At other times, the noise reduction analysis 72 will not be able to rule out a feedback transition event leading us to the main inquiry of whether the correlation coefficient $CC_{Hz}$ in this frequency band is high, such as a value over 0.9. If the correlation coefficient $CC_{Hz}$ in this frequency band is not high 146, then the feedback transition threshold only tracks 148 the current signal level as shown in FIG. 4. However, if the correlation is high 150 and the other tests have not ruled out feedback oscillation, then it is likely that the acoustic feedback path 40 is rapidly changing. Accordingly, the feedback transition threshold adjustor 60 identifies a likely feedback transition event.

Most feedback transition events will have a duration less than 500 ms and more commonly within 16 to 100 ms in the correlation coefficient phase change data. For such a feedback transition event, it is unlikely that the FIR filter 42 can be adjusted quickly and accurately enough (even with the SPM algorithm) to compensate for the rapidity of the external feedback path 40 changes. It is estimated that feedback transition events will be identified very rarely during the majority of hearing aid conditions, such as during 1 percent or less of common conditions for the average hearing aid user, and more preferably during about 0.1 percent or less of common hearing aid conditions. For instance, for an average hearing aid user it is estimated that feedback transition events will be identified for 60 seconds or less during an average day of 57600 seconds of hearing aid use.

During a feedback transition event, there is clearly something happening in this frequency band 22, and there is a reasonable probability that the hearing aid is generating a feedback squeal. When the feedback transition event is identified, the amount by which the feedback transition threshold is reduced depends upon a frequency band lookup 152. Particularly if correlation coefficients in the 2.5 kHz, 3 kHz and 3.5 kHz bands are high, and especially in two or more neighboring bands in these 2.5 kHz, 3 kHz and 3.5 kHz bands, the result is likely to be a major reduction 76. In the 1.5 kHz, 2 kHz bands and within the 4.0 to 6.5 kHz bands, whether to use a major feedback transition threshold reduction 76 or a minor feedback transition threshold reduction 78 depends upon the programmed, fitted gain with that band.

Figure 5:
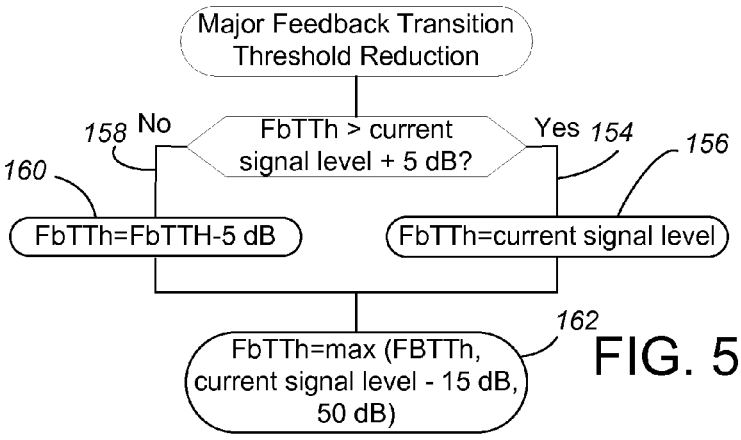
FIG. 5 is a flow chart of the preferred major feedback transition reduction algorithm of the present invention.

The specific algorithm used for a major feedback transition threshold reduction 76 is shown in FIG. 5. If the feedback transition threshold is more 154 than 5 dB higher than the level of the signal in this frequency band 22, then the feedback transition threshold is reduced 156 to the current signal level. If the feedback transition threshold is less 158 than 5 dB higher than the level of the signal in this frequency band 22, then it is reduced 160 by 5 dB. In either event 156, 160, the feedback transition threshold is not reduced 162 to a value of over 15 dB less than the current signal level. Nor is the feedback transition threshold reduced 162 to a value of less than 50 dB. These limits 156, 160, 162 are satisfactory to ensure that the feedback oscillation does not become excessively loud.

Figure 6:
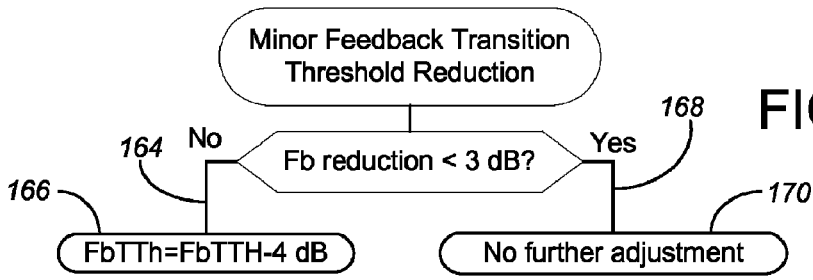
FIG. 6 is a flow chart of the preferred minor feedback transition reduction algorithm of the present invention.

The specific algorithm used for a minor feedback transition threshold reduction 76, 128 is shown in FIG. 6. If gain reduction in amplifier 62 is minimal 164 (less than 3 dB of reduction) then the feedback transition threshold is reduced 166 by 4 dB. Otherwise 168, since the amplifier 62 is already significantly reducing gain within this frequency band 22, the feedback transition threshold is not further adjusted 170 during this iteration.

The reduced feedback transition gain threshold continues until either the correlation coefficients or the FIR filter coefficients stabilize. By temporarily reducing 76, 78, 128 the feedback transition threshold, the output level in that frequency band 22 is assured to be kept low. Some feedback or entrainment might still be audible, but those oscillations will be kept at a quiet level at least until the feedback adaptive FIR filter 42 or the small phase change measurement algorithm 58 can handle the new feedback conditions. To a hearing aid user, the audible feedback or entrainment oscillations with the present invention might be personally heard, but cannot be heard by others in close proximity to the hearing aid wearer.

Figure 7:
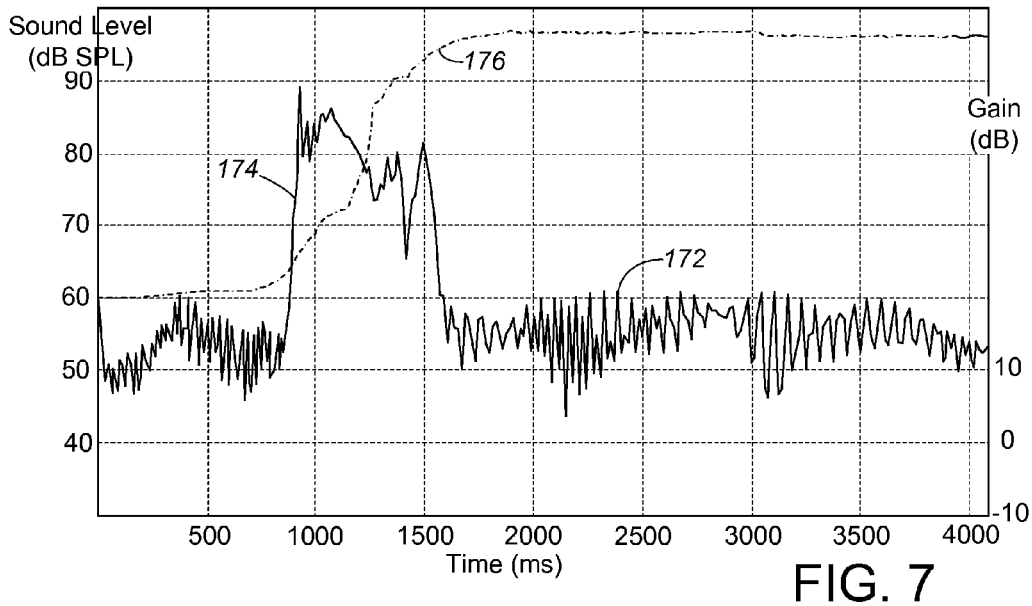
FIG. 7 is a graph of channel gain versus output signal of a feedback transition event using the hearing aid of FIG. 1.
Figure 8:
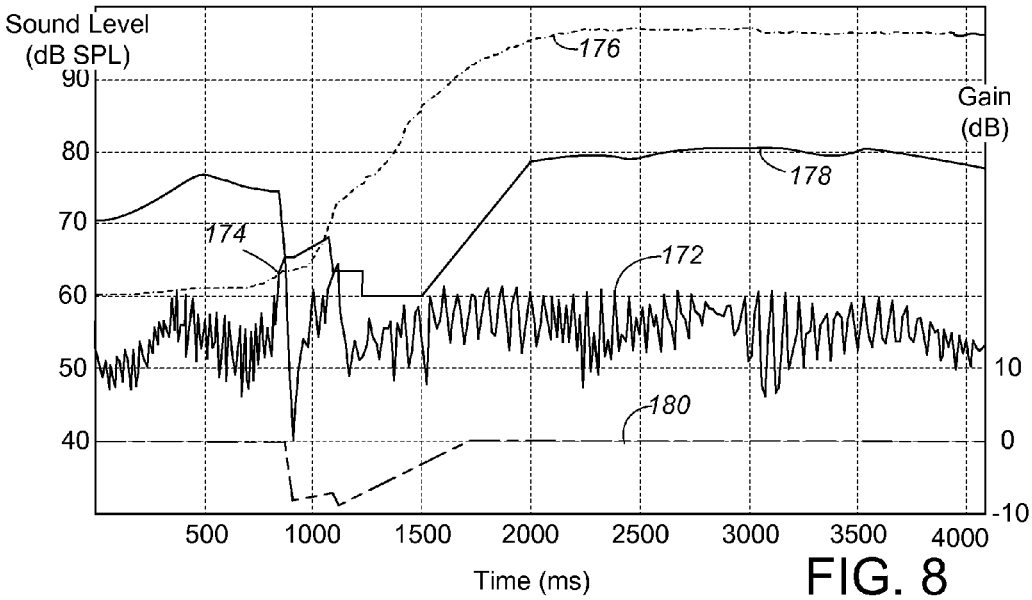
FIG. 8 is a graph of channel gain versus output signal of the same feedback transition event using the hearing aid of FIGS. 2-6.

FIGS. 7 and 8 demonstrate the effectiveness of the preferred feedback transition adjustment. In FIG. 7, the signal level 172 over a 4 second (4000 ms) time frame within a 3.0-3.5 kHz band ("3.0 KHz band") is shown using the prior hearing aid 10 of FIG. 1. The time period of feedback squeal 174 cause by a feedback transition event is easily identified, wherein the signal level increased to uncomfortable levels. A summary of the μ coefficients 176 of the LMS-controlled FIR feedback filter 42 is also plotted, showing their reaction and stabilizing after the feedback transition event. Once the feedback transition was over, the hearing aid including the LMS-controlled FIR feedback filter 42 using the SPM algorithm 58 brought the signal 172 within this 3.0 kHz band back into stability within less than a second for continued operation. Despite the rapid adaptive adjustment of the LMS-controlled FIR feedback filter 42, it still didn't completely prevent the feedback squeal.

FIG. 8 shows the circuit of the present invention as applied to the identical incoming sound. In addition to showing the 3.0 kHz signal level 172 and μ coefficient summary 176, FIG. 8 also shows the feedback transition threshold 178 and the gain reduction 180 in the amplifier 62. For the first 800 ms or so before the feedback transition event began, the feedback transition threshold 178 was smoothly tracking at about 21 dB over the 3.0 kHz signal level 172. Then when the feedback transition event began, the algorithm of FIGS. 3-6 quickly identified the likelihood of feedback oscillation and quickly reduced the feedback transition threshold. The feedback transition adjustment algorithm of the present invention identified the existence of the feedback transition event very within 16 or 32 ms, i.e., the existence of the feedback transition event was identified much more quickly than the cure. When the signal level 172 hit the feedback transition threshold 178, the gain reduction 180 in the amplifier 62 quickly changed from 0 dB to about −9 dB, just after the feedback oscillation started. The gain reduction 180 greatly helped to minimize the feedback squeal, but actually overshot somewhat, and without feedback oscillation, the signal level 172 decreased at the lower gain. The gain reduction 180 in the amplifier has its own release time, that attempts to move the gain reduction back to 0 dB unless an adjustment is made due to the feedback transition threshold 178. In this case, the feedback transition event was still continuing, and in fact the signal level 172 hit the feedback transition threshold 178 a second time, causing a second decrease in the gain reduction 180 at about 1100 ms. The feedback transition threshold underwent a third reduction at about 1250 ms, but this time the signal level was too low to result in a reduction in gain 180. Accordingly, the release time of the gain reduction 180 carried the gain back to 0 dB over the 1200 to 1700 ms time window. Meanwhile, the feedback transition event ended at about 1500 ms, after which the tracking algorithm carried the feedback transition threshold 178 back up to a level of 21 dB over the signal 172. For the last two seconds shown, after the FIR coefficients were handling the new feedback conditions, the feedback transition threshold 178 merely tracked the signal 172. During the 700 ms or so time period that the feedback transition event was occurring, the feedback chirp or artifact was still slightly audible, but now was at a much more comfortable level. The FIR coefficients 176 actually responded a little more slowly to the feedback transition event with the present invention, but the gain reduction 180 more than made up for the slightly slower response time by making the feedback chirp at a much lower volume and duration.

Regardless of the number and complexity of steps used to identify a likely feedback transition event and to rule out other causes, the idea of this invention is to use the feedback transition threshold adjustor 60 during this transition period to limit the level of the oscillation to a very low amplitude. Limiting the level of the oscillations is not as desirable as true cancellations, but it is much more desirable to the wearer than loud oscillations. Because the situations of identified feedback transition events only occur several times a day and have a short (less than about 2 seconds) duration, the periods of abnormally low limits to the feedforward gain levels are infrequent and hence of insignificant detriment to overall signal quality.

Once a feedback transition event is identified, the limiting of the output level within an offending frequency band 22 could be done by several alternative means. As opposed to the gain amplifier 62 shown in FIG. 3, the output level could be limited after the applied gain, referred to as output referenced compression. The limiting of the level might also be possible by changing the compression ratio or other means.

After the feedback transition event concludes and the external acoustic path 40 stabilizes, the internal path 44 can be adapted to match it. When this occurs, the correlation of the input and output of the shift register 54 in the correlation detector 52 drops. This in turn will allow the gain limiting threshold to smoothly track back to its desired value (as determined by the fitting of that particular individual), such as increasing no more than 2 dB (and more commonly 1 dB or less) every 16 ms. The total time during which the threshold is reduced due to a feedback transition event is about 2 seconds or less after the conclusion of the feedback transition event, and typically within a few hundred milliseconds after the conclusion of the feedback transition event.

The effect of the reduction of the maximum output threshold on the sound quality is minimal for several reasons. First, the reduction is only for a narrow band 22 of frequencies; second, the reduction is only when the feedback path 40 is rapidly changing and so is a rare event; third, the reduction is only for a limited time period; and fourth, the level is limited so that if the level is naturally below the threshold no gain change is applied. An advantage of changing just the threshold level is that if there is a false reduction, i.e. there is no true external feedback change, the error only results in a reduction of the maximum gain level. If the input is low during the error period, there will be no effect on the audio signal. Even if the audio signal is high during this error, the signal will only be reduced in level but still passed through.

The preferred embodiment applies the feedback transition adjustment algorithm 60 in a cost effective manner by adding a few subroutines without changing the parameters of the existing compression circuit. The present invention does not require the normal compression and the feedback transition adjustment to share the same variables. One advantage of separating the limiting functions is that the variables for feedback transition adjustment could then be set different from the variables for the normal compression. As one example, the normal compression algorithm may use 2 or 4 different frequency bands 22, while the preferred feedback transition adjustment is performed in 12 or 16 frequency bands 22. Another example is that the feedback transition threshold adjustment works best if the limiting attack and release times are fast, <15 ms and <200 ms respectively, which may be considerably faster than the desired normal compression times.

Although the present invention has been described with reference to preferred embodiments, workers skilled in the art will recognize that changes may be made in form and detail without departing from the spirit and scope of the invention. For instance, while the present invention is explained as an improvement to the circuit of U.S. Pat. No. 7,519,193, the invention can be equally applied to a wide variety of different hearing aid designs. In particular, the present invention benefits from using a correlation detector 52 which was already present for other prior art purposes, but could be equally applied with a dedicated correlation detector or other form of short duration trouble indicator. The key aspect is that short duration trouble indicator be used to temporarily reduce gain in the trouble frequency band 22 during the external feedback path event, and then upon signal stabilizing quickly and smoothly restore full gain and full control to the feedforward and adaptive feedback algorithms.

What is claimed is:

1. A hearing aid comprising:

a microphone converting an acoustic signal into an electrical signal;

a hearing aid signal processing circuit receiving the electrical signal from the microphone, the signal processing circuit comprising:

a digital amplifier which provides a gain to the electrical signal;

an adaptive feedback reduction algorithm;

an algorithm for detecting when an external feedback transition event is occurring within a selected frequency band, wherein the algorithm for detecting when an external feedback transition event is occurring performs a correlation assessment of data frames across an estimated feedback circuit delay time in a plurality of frequency bands; and a threshold gain algorithm to temporarily reduce gain in a selected frequency band upon detection of the external feedback transition event; and a receiver electrically driven by the output of the hearing aid signal processing circuit to produce a real-time generated acoustic sound within the ear of a hearing impaired individual wearing the hearing aid.

2. A hearing aid comprising a micro shone converting an acoustic signal into an electrical signal;

a hearing aid signal processing circuit receiving the electrical signal from the microphone, the signal processing circuit comprising:

a digital amplifier which provides a gain to the electrical signal;

an adaptive feedback reduction algorithm;

an algorithm for detecting when an external feedback transition event is occurring within a selected frequency band, wherein the algorithm for detecting when an external feedback transition event is occurring calculates at least one short duration trouble indicator; and a threshold gain algorithm to temporarily reduce gain in a selected frequency band upon detection of the external feedback transition event; and a receiver electrically driven by the output of the hearing aid signal processing circuit to produce a real-time generated acoustic sound within the ear of a hearing impaired individual wearing the hearing aid.

3. The hearing aid of claim 2, wherein the calculated short duration trouble indicator comprises a correlation coefficient in each frequency band.

4. The hearing aid of claim 3, wherein, when no external feedback transition event is occurring, the algorithm performs a tracking function, wherein the tracking function involves a small increase or decrease to a feedback transition threshold relative to a current signal level, with the feedback transition threshold controlling the temporary reduction in gain in the selected frequency subband.

5. The hearing aid of claim 4, wherein the tracking function involves an additional small increase to the feedback transition threshold when the feedback transition threshold is below a minimal value.

6. The hearing aid of claim 4, wherein the tracking function involves a preliminary verification that either the correlation coefficient in the particular frequency band is low or the correlation coefficient in all frequency bands is low.

7. The hearing aid of claim 4, wherein the total time during which the feedback transition threshold is reduced due to a detected external feedback transition event is about 2 seconds or less after the conclusion of the external feedback transition event.

8. The hearing aid of claim 4, wherein the algorithm for detecting when an external feedback transition event is occurring performs a preliminary step of calculating the initial tightness of correlation data, with the initial tightness of the correlation data being calculated as the standard deviation over the mean of the correlation coefficient data points, and wherein the tracking function is performed for a first iteration upon identifying tight correlation data.

9. The hearing aid of claim 8, wherein the algorithm for detecting when an external feedback transition event is occurring performs a subsequent step of calculating the tightness of correlation data on a subsequent iteration, and wherein the tracking function is performed upon identifying subsequent iteration loose correlation data.

10. The hearing aid of claim 3, wherein the algorithm for detecting when an external feedback transition event is occurring performs a comparison of correlation coefficients over a feedback loop delay to correlation coefficients over a shorter delay.

11. The hearing aid of claim 10, wherein if a ratio of the shorter delay correlation coefficients to the feedback loop delay correlation coefficients is well over unity, then the algorithm performs a tracking function, wherein the tracking function involves a small increase or decrease to a feedback transition threshold relative to a current signal level, with the feedback transition threshold controlling the temporary reduction in gain in the selected frequency subband.

12. The hearing aid of claim 3, wherein the algorithm for detecting when an external feedback transition event is occurring performs a low frequency cepstrum analysis and power check to assess whether the high correlation coefficients in the frequency band are caused by a buzz sound.

13. The hearing aid of claim 3, wherein the algorithm for detecting when an external feedback transition event is occurring performs a noise reduction analysis, with active noise reduction indicating that no external feedback transition event is occurring.

14. The hearing aid of claim 3, wherein the threshold gain algorithm selects between a minor feedback transition threshold adjustment and a major feedback transition threshold adjustment.

15. The hearing aid of claim 3, wherein external feedback transition events are identified at 1 percent or less of common conditions for an average hearing aid user.

16. The hearing aid of claim 1, wherein the amount of gain reduction in a selected frequency band from the threshold gain algorithm depends upon current signal level in the selected frequency band.

17. A method of processing a digital hearing aid signal, comprising:

separating the digital hearing aid signal into frequency bands;

providing gain to a frequency band signal during standard operation;

performing an adaptive feedback reduction algorithm during standard operation;

detecting when an external feedback transition event is occurring within the frequency band, wherein an algorithm for detecting when an external feedback transition event is occurring performs a correlation assessment of data frames across an estimated feedback circuit delay time in a plurality of frequency bands; and using a threshold gain algorithm to temporarily reduce gain in the frequency band upon detection of the external feedback transition event.

18. A digital signal processor for a hearing aid, the digital signal processor providing gain to frequency band electrical signals during standard operation, the digital signal processor comprising:

an adaptive feedback reduction algorithm;

an algorithm for detecting when an external feedback transition event is occurring within a selected frequency band, wherein the algorithm for detecting when an external feedback transition event is occurring performs a correlation assessment of data frames across an estimated feedback circuit delay time in a plurality of frequency bands; and a threshold gain algorithm to temporarily reduce gain in a selected frequency band upon detection of the external feedback transition event.

19. The digital signal processor of claim 18, wherein the amount of gain reduction in a selected frequency band from the threshold gain algorithm depends upon current signal level in the selected frequency band.

20. A digital signal processor for a hearing aid, the digital signal processor providing gain to frequency band electrical signals during standard operation, the digital signal processor comprising:

an adaptive feedback reduction algorithm;

an algorithm for detecting when an external feedback transition event is occurring within a selected frequency band, wherein the algorithm for detecting when an external feedback transition event is occurring calculates at least one short duration trouble indicator; and a threshold gain algorithm to temporarily reduce gain in a selected frequency band upon detection of the external feedback transition event.

21. The digital signal processor of claim 20, wherein the calculated short duration trouble indicator comprises a correlation coefficient in each frequency band.

22. The digital signal processor of claim 21, wherein, when no external feedback transition event is occurring, the algorithm performs a tracking function, wherein the tracking function involves a small increase or decrease to a feedback transition threshold relative to a current signal level, with the feedback transition threshold controlling the temporary reduction in gain in the selected frequency subband.

23. The digital signal processor of claim 22, wherein the tracking function involves an additional small increase to the feedback transition threshold when the feedback transition threshold is below a minimal value.

24. The digital signal processor of claim 22, wherein the tracking function involves a preliminary verification that either the correlation coefficient in the particular frequency band is low or the correlation coefficient in all frequency bands is low.

25. The digital signal processor of claim 22, wherein the total time during which the feedback transition threshold is reduced due to a detected external feedback transition event is about 2 seconds or less after the conclusion of the external feedback transition event.

26. The digital signal processor of claim 22, wherein the algorithm for detecting when an external feedback transition event is occurring performs a preliminary step of calculating the initial tightness of correlation data, with the initial tightness of the correlation data being calculated as the standard deviation over the mean of the correlation coefficient data points, and wherein the tracking function is performed for a first iteration upon identifying tight correlation data.

27. The digital signal processor of claim 26, wherein the algorithm for detecting when an external feedback transition event is occurring performs a subsequent step of calculating the tightness of correlation data on a subsequent iteration, and wherein the tracking function is performed upon identifying subsequent iteration loose correlation data.

28. The digital signal processor of claim 3, wherein the algorithm for detecting when an external feedback transition event is occurring performs a comparison of correlation coefficients over a feedback loop delay to correlation coefficients over a shorter delay.

29. The digital signal processor of claim 10, wherein if a ratio of the shorter delay correlation coefficients to the feedback loop delay correlation coefficients is well over unity, then the algorithm performs a tracking function, wherein the tracking function involves a small increase or decrease to a feedback transition threshold relative to a current signal level, with the feedback transition threshold controlling the temporary reduction in gain in the selected frequency subband.

30. The digital signal processor of claim 21, wherein the algorithm for detecting when an external feedback transition event is occurring performs a low frequency cepstrum analysis and power check to assess whether the high correlation coefficients in the frequency band are caused by a buzz sound.

31. The digital signal processor of claim 21, wherein the algorithm for detecting when an external feedback transition event is occurring performs a noise reduction analysis, with active noise reduction indicating that no external feedback transition event is occurring.

32. The digital signal processor of claim 21, wherein the threshold gain algorithm selects between a minor feedback transition threshold adjustment and a major feedback transition threshold adjustment.

33. The digital signal processor of claim 21, wherein external feedback transition events are identified at 1 percent or less of common conditions for an average hearing aid user.

34. The method of processing a digital hearing aid signal of claim 18, wherein the amount of gain reduction in a selected frequency band from the threshold gain algorithm depends upon current signal level in the selected frequency band.

35. A method of processing a digital hearing aid signal for a hearing aid, comprising:

separating the digital hearing aid signal into frequency bands;

providing gain to a frequency band signal during standard operation;

performing an adaptive feedback reduction algorithm during standard operation;

detecting when an external feedback transition event is occurring within the frequency band, wherein an algorithm for detecting when an external feedback transition event is occurring calculates at least one short duration trouble indicator; and using a threshold gain algorithm to temporarily reduce gain in the frequency band upon detection of the external feedback transition event.

36. The method of processing a digital hearing aid signal of claim 35, wherein the calculated short duration trouble indicator comprises a correlation coefficient in each frequency band.

37. The method of processing a digital hearing aid signal of claim 36, wherein, when no external feedback transition event is occurring, the algorithm performs a tracking function, wherein the tracking function involves a small increase or decrease to a feedback transition threshold relative to a current signal level, with the feedback transition threshold controlling the temporary reduction in gain in the selected frequency subband.

38. The method of processing a digital hearing aid signal of claim 37, wherein the tracking function involves an additional small increase to the feedback transition threshold when the feedback transition threshold is below a minimal value.

39. The method of processing a digital hearing aid signal of claim 37, wherein the tracking function involves a preliminary verification that either the correlation coefficient in the particular frequency band is low or the correlation coefficient in all frequency bands is low.

40. The method of processing a digital hearing aid signal of claim 37, wherein the total time during which the feedback transition threshold is reduced due to a detected external feedback transition event is about 2 seconds or less after the conclusion of the external feedback transition event.

41. The method of processing a digital hearing aid signal of claim 37, wherein the algorithm for detecting when an external feedback transition event is occurring performs a preliminary step of calculating the initial tightness of correlation data, with the initial tightness of the correlation data being calculated as the standard deviation over the mean of the correlation coefficient data points, and wherein the tracking function is performed for a first iteration upon identifying tight correlation data.

42. The method of processing a digital hearing aid signal of claim 41, wherein the algorithm for detecting when an external feedback transition event is occurring performs a subsequent step of calculating the tightness of correlation data on a subsequent iteration, and wherein the tracking function is performed upon identifying subsequent iteration loose correlation data.

43. The method of processing a digital hearing aid signal of claim 36, wherein the algorithm for detecting when an external feedback transition event is occurring performs a comparison of correlation coefficients over a feedback loop delay to correlation coefficients over a shorter delay.

44. The method of processing a digital hearing aid signal of claim 43, wherein if a ratio of the shorter delay correlation coefficients to the feedback loop delay correlation coefficients is well over unity, then the algorithm performs a tracking function, wherein the tracking function involves a small increase or decrease to a feedback transition threshold relative to a current signal level, with the feedback transition threshold controlling the temporary reduction in gain in the selected frequency subband.

45. The method of processing a digital hearing aid signal of claim 36, wherein the algorithm for detecting when an external feedback transition event is occurring performs a low frequency cepstrum analysis and power check to assess whether the high correlation coefficients in the frequency band are caused by a buzz sound.

46. The method of processing a digital hearing aid signal of claim 36, wherein the algorithm for detecting when an external feedback transition event is occurring performs a noise reduction analysis, with active noise reduction indicating that no external feedback transition event is occurring.

47. The method of processing a digital hearing aid signal of claim 36, wherein the threshold gain algorithm selects between a minor feedback transition threshold adjustment and a major feedback transition threshold adjustment.

48. The method of processing a digital hearing aid signal of claim 36, wherein external feedback transition events are identified at 1 percent or less of common conditions for an average hearing aid user.

* * * * *

UNITED STATES PATENT AND TRADEMARK OFFICE

CERTIFICATE OF CORRECTION

PATENT NO. : 8,355,517 B1
APPLICATION NO. : 12/895831
DATED : January 15, 2013
INVENTOR(S) : Robert J. Fretz It is certified that error appears in the above-identified patent and that said Letters Patent is hereby corrected as shown below:

At Column 11, line 60, delete "micro shone" and insert therefore --microphone--.

Signed and Sealed this
Twenty-sixth Day of February, 2013

Teresa Stanek Rea
*Acting Director of the United States Patent and Trademark Office*